US011672396B2

(12) United States Patent
Takano

(10) Patent No.: US 11,672,396 B2
(45) Date of Patent: Jun. 13, 2023

(54) DUST EXTRACTOR

(71) Applicant: MAKITA CORPORATION, Anjo (JP)

(72) Inventor: Hideaki Takano, Anjo (JP)

(73) Assignee: MAKITA CORPORATION, Anjo (JP)

( * ) Notice: Subject to any disclaimer, the term of this patent is extended or adjusted under 35 U.S.C. 154(b) by 416 days.

(21) Appl. No.: 17/022,668

(22) Filed: Sep. 16, 2020

(65) Prior Publication Data

US 2021/0121031 A1 Apr. 29, 2021

(30) Foreign Application Priority Data

Oct. 24, 2019 (JP) ..... JP2019-193753

(51) Int. Cl.

| | |
|---|---|
| ***A47L 9/22*** | (2006.01) |
| ***A47L 5/36*** | (2006.01) |
| ***A47L 9/28*** | (2006.01) |
| ***A47L 9/00*** | (2006.01) |
| *A47L 9/32* | (2006.01) |

(52) U.S. Cl.

CPC ..... *A47L 9/22* (2013.01); *A47L 5/365* (2013.01); *A47L 9/0081* (2013.01); *A47L 9/2857* (2013.01); *A47L 9/2884* (2013.01); *A47L 9/327* (2013.01)

(58) Field of Classification Search

CPC ..... A47L 9/22; A47L 5/365; A47L 9/0081; A47L 9/2857; A47L 9/2884; A47L 9/327; A47L 9/242; A47L 9/00; F04D 25/0673; F04D 17/168; F04D 25/06; F04D 29/4226; F04D 29/668

See application file for complete search history.

(56) References Cited

U.S. PATENT DOCUMENTS 3,773,285 A * 11/1973 Morrill ..... F04D 29/668 244/230
3,910,717 A * 10/1975 Thome ..... F04D 29/668 415/124.2
4,978,281 A * 12/1990 Conger, IV ..... F04D 29/5806 417/424.2
5,159,738 A * 11/1992 Sunagawa ..... A47L 9/0081 181/231

(Continued)

FOREIGN PATENT DOCUMENTS

EP 0545003 A2 * 6/1993
EP 2907436 A1 * 8/2015 ..... A47L 9/0081

(Continued)

OTHER PUBLICATIONS

Office Action from the Japanese Patent Office dispatched Apr. 11, 2023 in counterpart JP application No. 2019-193753, and machine translation thereof.

(Continued)

*Primary Examiner* — Dung H Bui
(74) *Attorney, Agent, or Firm* — J-Tek Law PLLC; Jeffrey D. Tekanic; Scoff T. Wakeman

(57) ABSTRACT

A dust extractor (1) includes a motor (30) and a blower fan (40), which is disposed downward of the motor and is connected to the motor. The dust extractor further includes a flexible (pliable) support member (50; 500), which has a lower-end portion (52) connected to the motor and suspends the motor.

20 Claims, 14 Drawing Sheets

(56) References Cited

U.S. PATENT DOCUMENTS 5,567,127 A * 10/1996 Wentz ..... F04D 29/663 417/423.9
5,639,228 A * 6/1997 Van De Venne ..... F04D 25/08 415/214.1
5,647,570 A * 7/1997 Berfield ..... A47L 9/0081 15/326
5,894,629 A * 4/1999 Kim ..... A47L 9/0081 15/326
6,050,890 A * 4/2000 Bayer ..... F04D 29/668 248/634
6,279,866 B1 * 8/2001 Eilemann ..... F04D 29/668 248/603
6,448,678 B1 * 9/2002 Simpson ..... F16F 15/08 310/89
6,575,695 B1 * 6/2003 Miyamoto ..... B05B 7/1427 415/206
10,383,493 B2 * 8/2019 Tahara ..... A47L 5/36
2004/0086395 A1 * 5/2004 Rew ..... A47L 9/0081 417/360
2005/0022337 A1 * 2/2005 Roney ..... A47L 9/0081 15/326
2005/0069407 A1 * 3/2005 Winkler ..... B29C 45/0062 415/58.5
2006/0213022 A1 * 9/2006 Oh ..... A47L 9/22 15/326
2007/0050939 A1 * 3/2007 Dant ..... A47L 9/0081 15/327.2
2008/0040883 A1 * 2/2008 Beskow ..... A47L 9/20 15/329
2008/0175705 A1 * 7/2008 Liu ..... F04D 29/601 415/119
2008/0304986 A1 * 12/2008 Kenyon ..... F04D 25/08 417/423.12
2009/0189052 A1 * 7/2009 Naji ..... F04D 25/08 248/672
2009/0263242 A1 * 10/2009 Winkler ..... F04D 29/601 415/213.1
2010/0080717 A1 * 4/2010 Ho ..... F04D 25/08 415/119
2010/0218341 A1 * 9/2010 Sato ..... A47L 9/0081 15/412
2010/0223751 A1 * 9/2010 Liddell ..... A47L 9/22 15/326
2010/0266388 A1 * 10/2010 Kim ..... A47L 9/0081 415/119
2012/0233805 A1 * 9/2012 Williams ..... A47L 9/00 15/326
2014/0096339 A1 * 4/2014 Niederman ..... A47L 9/22 15/327.5
2014/0201939 A1 * 7/2014 Pruitt ..... E06B 7/16 15/301
2016/0164369 A1 * 6/2016 Wolf ..... F04D 29/668 310/51
2016/0166126 A1 * 6/2016 Morin ..... A47L 9/2857 15/319
2016/0298655 A1 * 10/2016 Wolf ..... F04D 25/06
2017/0296015 A1 * 10/2017 Hu ..... A47L 5/30
2017/0332855 A1 * 11/2017 Seo ..... A47L 9/28
2018/0028031 A1 * 2/2018 Ni ..... A47L 9/22
2018/0146628 A1 * 5/2018 Huo ..... A47L 9/2857
2018/0296048 A1 * 10/2018 Schippers ..... A47L 9/22
2019/0368507 A1 * 12/2019 Xu ..... F04D 29/4226
2020/0245835 A1 * 8/2020 Iwakami ..... A47L 9/2884
2021/0121031 A1 * 4/2021 Takano ..... F04D 29/668
2022/0133109 A1 * 5/2022 Van Den Bosch ..... A47L 9/22 15/300.1
2022/0341432 A1 * 10/2022 Kataoka ..... F04D 29/5806
2023/0008598 A1 * 1/2023 Zuo ..... A47L 9/0081

FOREIGN PATENT DOCUMENTS

EP 2907438 A1 8/2015
GB 1203515 A * 8/1970 ..... F04D 29/668
GB 2534304 A * 7/2016 ..... A47L 9/0081
JP 105822 C 1/1934
JP H04312429 A 11/1992
JP H0584194 A 4/1993
JP 2874401 B2 * 3/1999
JP 2874401 B2 3/1999
JP 2014079371 A 5/2014
KR 100767118 B1 * 10/2007 ..... A47L 9/0081

OTHER PUBLICATIONS

Search Report from the Japanese Patent Office dated Apr. 11, 2023 in counterpart JP application No. 2019-193753, and machine translation thereof.

* cited by examiner

DUST EXTRACTOR

CROSS-REFERENCE

The present application claims priority to Japanese patent application serial number 2019-193753 filed on Oct. 24, 2019, the contents of which are incorporated fully herein by reference.

TECHNICAL FIELD

The present disclosure generally relates to dust extractors, which are also known as vacuum cleaners or dust collectors.

BACKGROUND ART

Japanese Patent No. 2874401 discloses a known electric vacuum cleaner.

SUMMARY OF THE INVENTION

If the housing of a dust extractor (vacuum cleaner, dust collector, etc.) vibrates due to the operation of a motor and a blower fan therein, then unpleasant noise will be generated by the vibration.

An object of the present disclosure is to disclose techniques for curtailing the propagation of vibration from a motor and/or blower fan to thereby reduce noise generated by vibration.

According to one non-limiting aspect of the present disclosure, a dust extractor comprises a motor and a blower fan, which is disposed downward of the motor and is connected to the motor. A flexible support member has a lower-end portion connected to the motor and suspends the motor.

According to the above-mentioned non-limiting aspect of the present disclosure, propagation of vibration can be effectively curtailed by the flexible support member, thereby reducing noise caused by vibration.

DETAILED DESCRIPTION OF EMBODIMENTS OF THE PRESENT TEACHINGS

Figure 1:
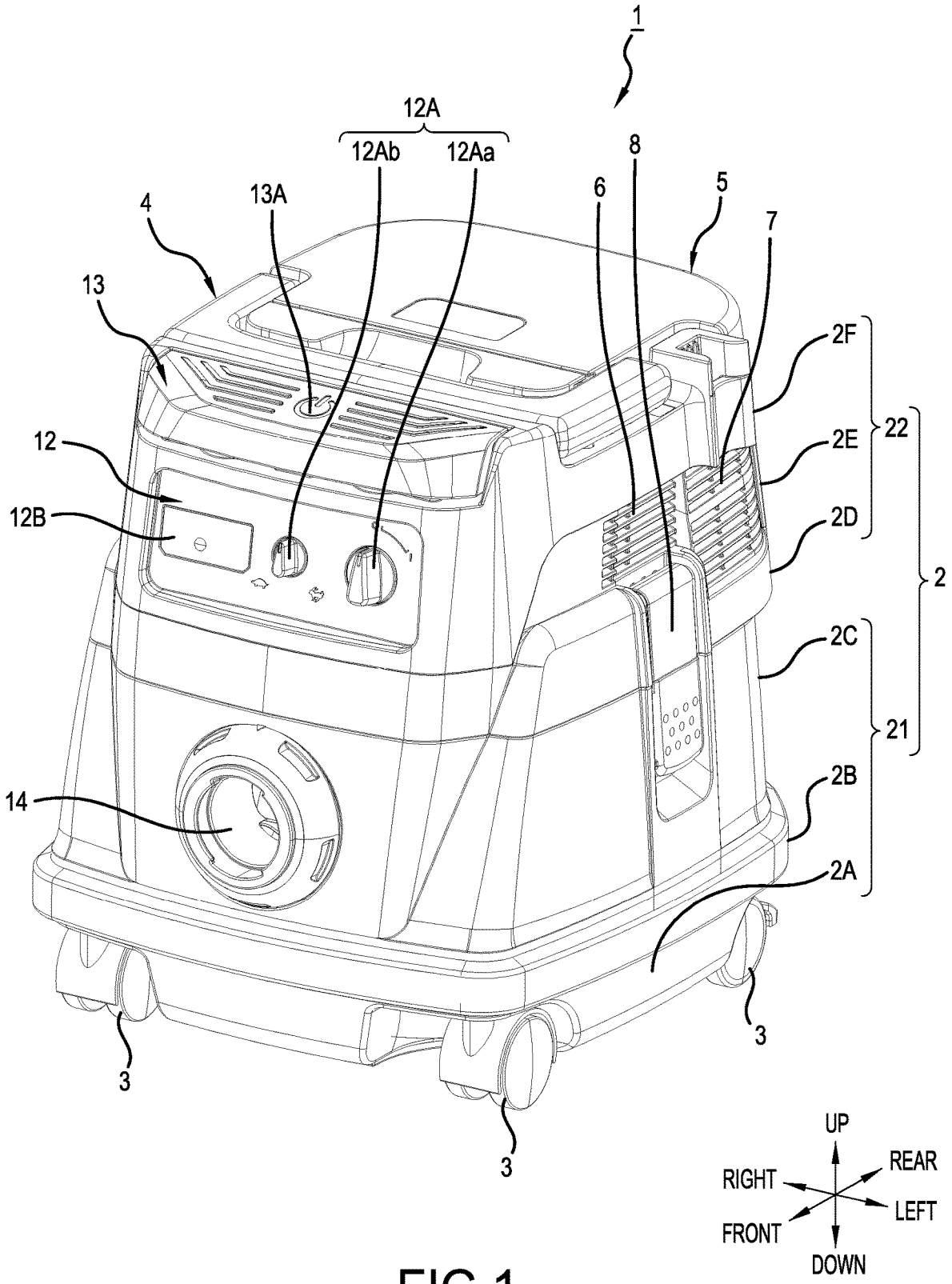
FIG. 1 shows an oblique view, viewed from the front, of a dust extractor according to a first, non-limiting embodiment of the present teachings.

Embodiments according to the present disclosure are explained below, with reference to the drawings, but the present disclosure is not limited to these embodiments. Structural elements of the embodiments explained below can be combined where appropriate. In addition or in the alternative, modified embodiments are also possible in which some of the structural elements are not used.

In the first and second embodiments described below, positional relationships among the parts are explained using the terms "left," "right," "front," "rear," "up," and "down." These terms indicate relative positions or directions, using the center of a dust extractor 1 as a reference, as shown by the reference arrows in the drawings.

Dust Extractor

Figure 2:
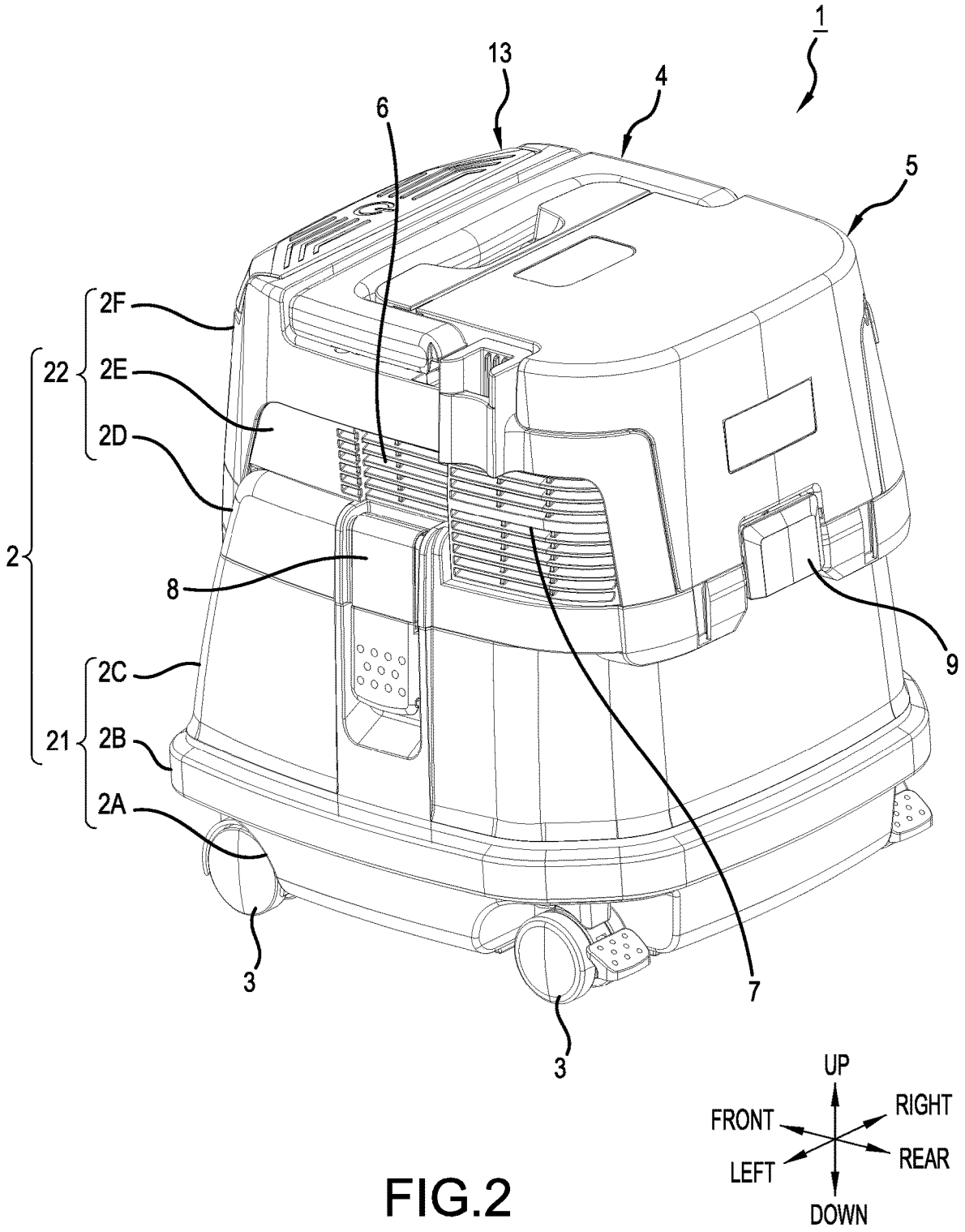
FIG. 2 shows an oblique view, viewed from the rear, of the dust extractor according to the first embodiment.

FIG. 1 shows an oblique view, viewed from the front, of a representative dust extractor 1 according to the first embodiment. FIG. 2 shows an oblique view, viewed from the rear, of the dust extractor 1.

As shown in FIGS. 1 and 2, the dust extractor 1 generally comprises a housing 2, castors 3, a handle 4, and a battery cover 5.

The housing 2 comprises a first housing portion 2A, a second housing portion 2B, a third housing portion 2C, a fourth housing portion 2D, a fifth housing portion 2E, and a sixth housing portion 2F.

The first housing portion 2A has a bottom plate. The second housing portion 2B has a frame shape (ring shape) and is disposed upward of the first housing portion 2A. The third housing portion 2C has a tube shape and is disposed upward of the second housing portion 2B. The first housing portion 2A, the second housing portion 2B, and the third housing portion 2C are fixed to one another.

In the explanation below, the first housing portion 2A, the second housing portion 2B, and the third housing portion 2C are collectively called a tank housing 21 where appropriate.

The fourth housing portion 2D has a frame shape (ring shape) and is disposed upward of the tank housing 21. The fifth housing portion 2E has an air-suction port 6 and an air-exhaust port 7. The fifth housing portion 2E is disposed upward of the fourth housing portion 2D. At least a portion of the sixth housing portion 2F is disposed upward of the fourth housing portion 2D and at least a portion of the sixth housing portion 2F is disposed upward of the fifth housing portion 2E.

The fourth housing portion 2D, the fifth housing portion 2E, and the sixth housing portion 2F are fixed to one another. In the explanation below, the fourth housing portion 2D, the fifth housing portion 2E, and the sixth housing portion 2F are collectively called a main-body housing 22 where appropriate.

The main-body housing 22 is disposed upward of the tank housing 21 and is detachable from the tank housing 21. The tank housing 21 and the main-body housing 22 are detachably fixed to one another by a pair of manually-operable latches 8.

The castors 3 are coupled to the first housing portion 2A and movably support the housing 2. This, the dust extractor 1 is capable of moving across a surface to be cleaned on the rollable castors 3.

The handle 4 is pivotably supported on the sixth housing portion 2F such that a user of the dust extractor 1 can carry the dust extractor 1 by holding the handle 4.

The battery cover 5 is pivotably supported on the sixth housing portion 2F and is disposed rearward of the handle 4. A rear portion of the battery cover 5 is fixable to the fourth housing portion 2D by a manually-operable hook 9.

Figure 3:
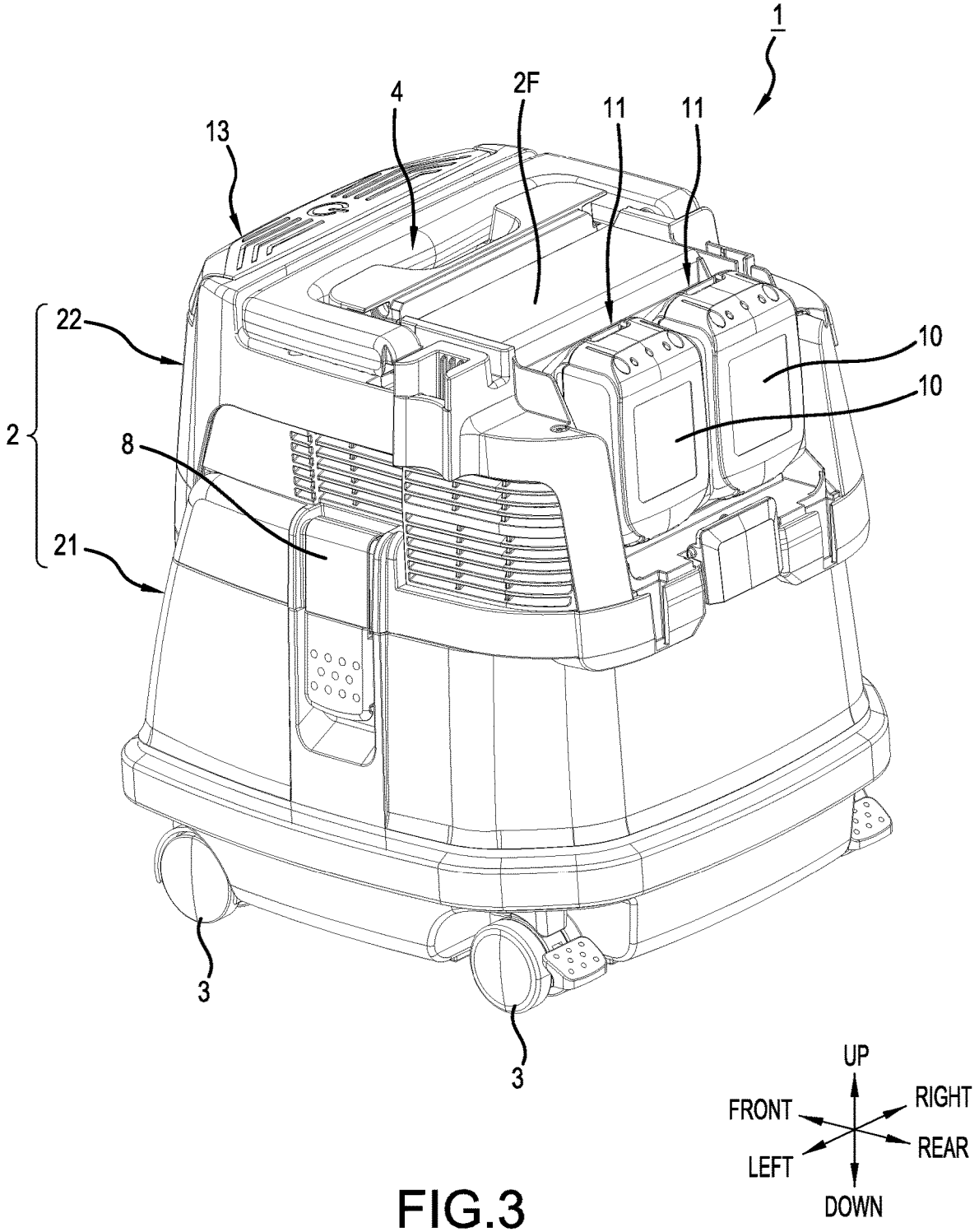
FIG. 3 shows an oblique view, viewed from the rear, of the dust extractor according to the first embodiment.

FIG. 3 shows an oblique view, viewed from the rear, of the dust extractor 1 similar to FIG. 2, but showing the battery cover 5 removed from the dust extractor 1 as compared to FIG. 2.

As shown in FIG. 3, the dust extractor 1 comprises two battery-mounting parts 11, on which two batteries (battery packs, battery cartridges) 10 are respectively mounted. The battery-mounting parts 11 are provided on a rear portion of the sixth housing portion 2F. A housing space, in which the battery-mounting parts 11 are housed, is formed between the battery cover 5 and the sixth housing portion 2F. The battery-mounting parts 11 are preferably aligned side-by-side and are oriented vertically so that the batteries 10 can be mounted thereon by sliding downwardly and can be removed therefrom by sliding upwardly. However, the arrangement of the battery-mounting parts 11 may be modified in accordance with the application of the present teachings. For example, the battery-mounting parts 11 may be spaced apart and/or oriented differently, e.g., so that the batteries 10 are mounted/removed from the battery mounting-parts 11 by sliding in a lateral (e.g., front-rear or left-right) direction.

The batteries 10, when mounted on the battery-mounting parts 11, supply electric power (current) to, e.g., a drive unit 100, which is installed in the dust extractor 1. The batteries 10 are adapted/configured to be used as the power supply for various types of electrical work machines, such as power tools, outdoor power equipment, etc. That is, the batteries 10 are preferably designed to be usable as the power supply of a dust extractor different from the dust extractor 1 according to the embodiment, or as the power supply of other types of power tools, etc. The batteries 10 preferably contain one or more rechargeable lithium-ion battery cells, although other types of battery chemistries may be utilized with the present teachings, which are not limited in this regard. The battery-mounting parts 11 have the same type of structure as the battery-mounting parts of a power tool.

The user of the dust extractor 1 can mount the batteries 10 on the battery-mounting parts 11 and remove the batteries 10 from the battery-mounting parts 11. The battery-mounting parts 11 have guide members (e.g., slide rails, tongues, etc.), which guide the batteries 10 being mounted, and main-body terminals, which are respectively connected to battery terminals (and optionally to one or more signal terminals) provided on the batteries 10. As was mentioned above, the user can mount the batteries 10 on the battery-mounting parts 11 by inserting (sliding) the batteries 10 into (onto) the battery-mounting parts 11 from above. The batteries 10 are inserted into (slid onto) the battery-mounting parts 11 while being guided by the guide members. When the batteries 10 are mounted on the battery-mounting parts 11, the electrical terminals of the batteries 10 are electrically connected to the main-body terminals of the battery-mounting parts 11. The user of the dust extractor 1 can remove the batteries 10 from the battery-mounting parts 11 by moving (sliding) the batteries 10 upward.

As shown in FIGS. 1 and 2, the dust extractor 1 comprises an operation panel 12 and a motor ON/OFF button (motor driving button) 13.

The operation panel 12 is disposed on a front portion of the sixth housing portion 2F. The operation panel 12 comprises a manually-operable part 12A, which is manually operable to control the operation of the dust extractor 1, and a display part 12B, which is adapted/configured to display one or more operating states of the dust extractor 1 and/or the batteries 10. A stand-by switch (switch lever) 12Aa for switching the dust extractor 1 between an OFF state and a stand-by state and a suction-force adjustment switch dial (knob) 12Ab are illustrative examples of the components of the manipulatable part 12A. A battery-remaining-charge display part, which displays the remaining charge of each of the batteries 10, is an illustrative example of the display part 12B.

The motor ON/OFF button 13 is disposed upward of the first operation panel 12 on the front portion of the sixth housing portion 2F. The motor ON/OFF button 13 is pivotably supported by the sixth housing portion 2F and turns ON a motor 30 (see below) when the motor ON/OFF button 13 is pressed and the stand-by switch 12Aa is in the stand-by position. That is, the motor 30 can be turned ON (operated) only when the stand-by switch 12Aa is set to "stand by" (position "1" in FIG. 1) and the motor 30 can not be (is prevented from being) turned ON when the stand-by switch 12Aa is set to "OFF" (position "0" in FIG. 1). Thus, when the stand-by switch 12Aa is set to "stand by", the motor 30 can be turned ON and OFF with one-touch (one press) of motor ON/OFF button 13. A motor ON/OFF display lamp (icon) 13A, which optionally includes one or more LEDs that may be illuminated when the motor 30 is operating, is provided in a middle of the motor ON/OFF button 13.

The housing 2 comprises a suction port 14, to which a hose is connectable. The suction port 14 is provided on (in) a front surface of the third housing portion 2C.

Figure 4:
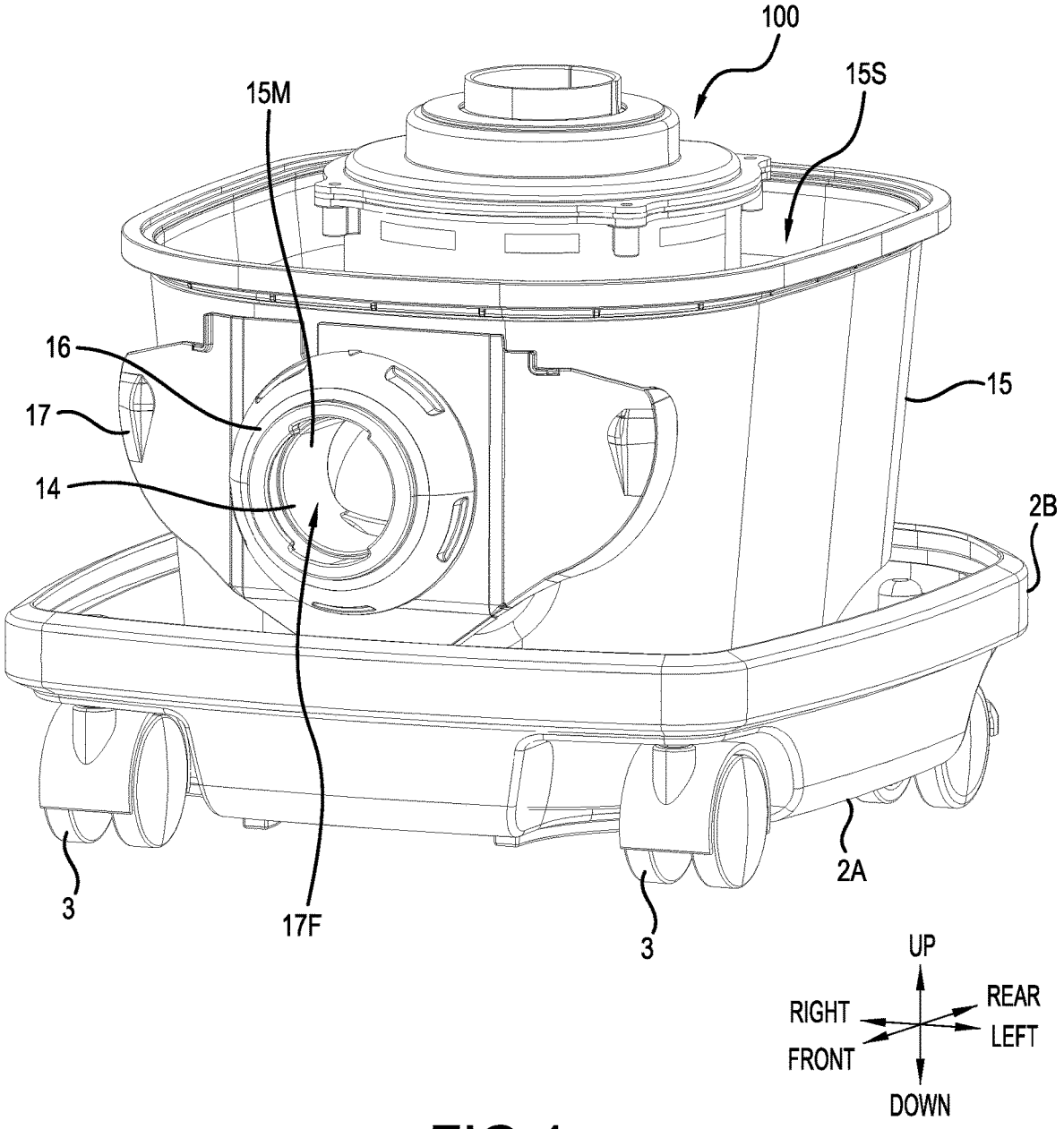
FIG. 4 shows an oblique view of the interior of a tank housing according to the first embodiment.
Figure 5:
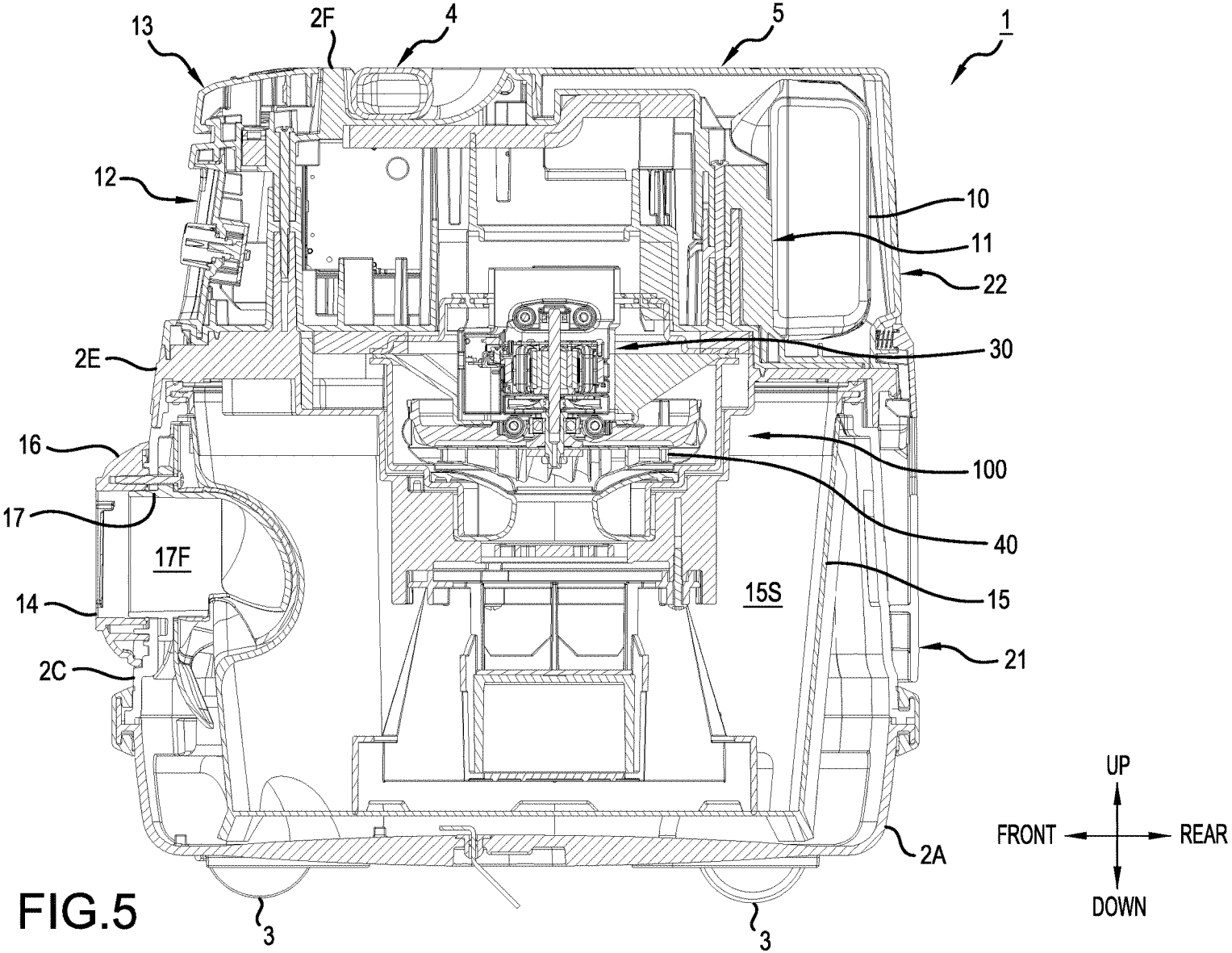
FIG. 5 shows a cross-sectional view of the dust extractor according to the first embodiment.

FIG. 4 shows an oblique view of the dust extractor 1, in which the third housing portion 2C has been removed to show the interior of the tank housing 21. FIG. 5 is a cross-sectional view of the dust extractor 1.

As shown in FIGS. 4 and 5, the tank housing 21 houses a tank 15 that is adapted/configured to hold dust, debris, etc. suctioned by the dust extractor 1 via the hose. At least a portion of the tank 15 is supported by the first housing portion 2A. The tank 15 has an opening 15M, which is fluidly connected to the suction port 14. Therefore, the suction port 14 is fluidly connected with an interior space 15S of the tank 15.

A joint member 16 is disposed around the suction port 14. The joint member 16 detachably holds the hose when the hose is connected to the suction port 14. The joint member 16 is supported by the second housing portion 2B via a support plate 17. The support plate 17 has a passageway 17F that fluidly connects the suction port 14, which is formed in the tank housing 21, and the opening 15M, which is formed in the tank 15.

The dust extractor 1 further comprises the above-mentioned drive unit 100, which is housed in the housing 2. At least a portion of the drive unit 100 is disposed in the interior space 15S of the tank 15.

The drive unit 100 causes a suction force to be generated in (at) the suction port 14. The drive unit 100 comprises a motor 30 and a blower fan (centrifugal fan) 40, which is connected to the motor 30. The blower fan 40 is disposed downward of the motor 30.

The motor 30 generates power (a rotational driving force) that causes the blower fan 40 to rotate. The motor 30 is driven by the electric power supplied from the batteries 10. Therefore, the suction force is generated in (at) the suction port 14 when the blower fan 40 rotates.

Drive Unit

Figure 6:
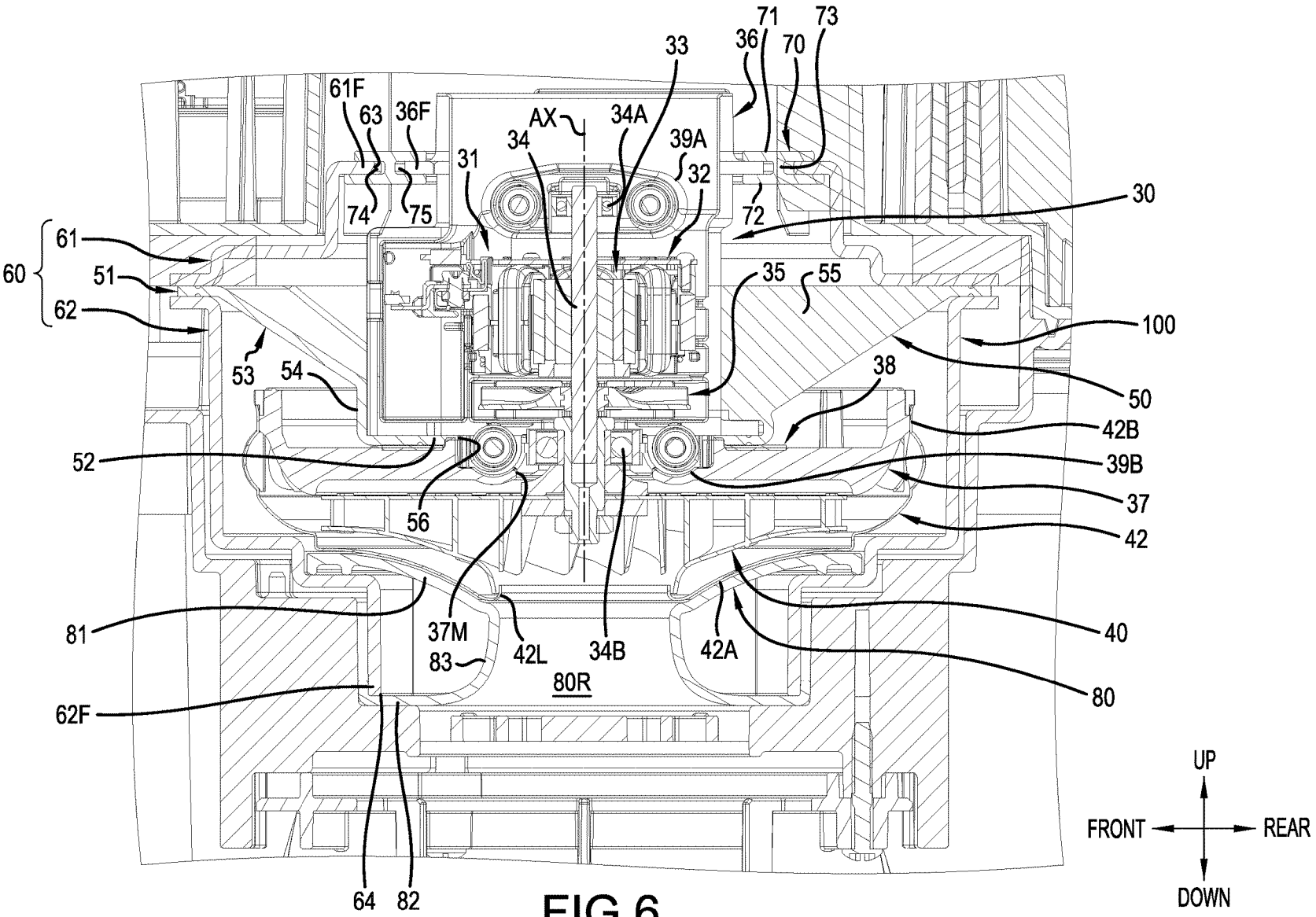
FIG. 6 shows a cross-sectional view of a drive unit according to the first embodiment.
Figure 7:
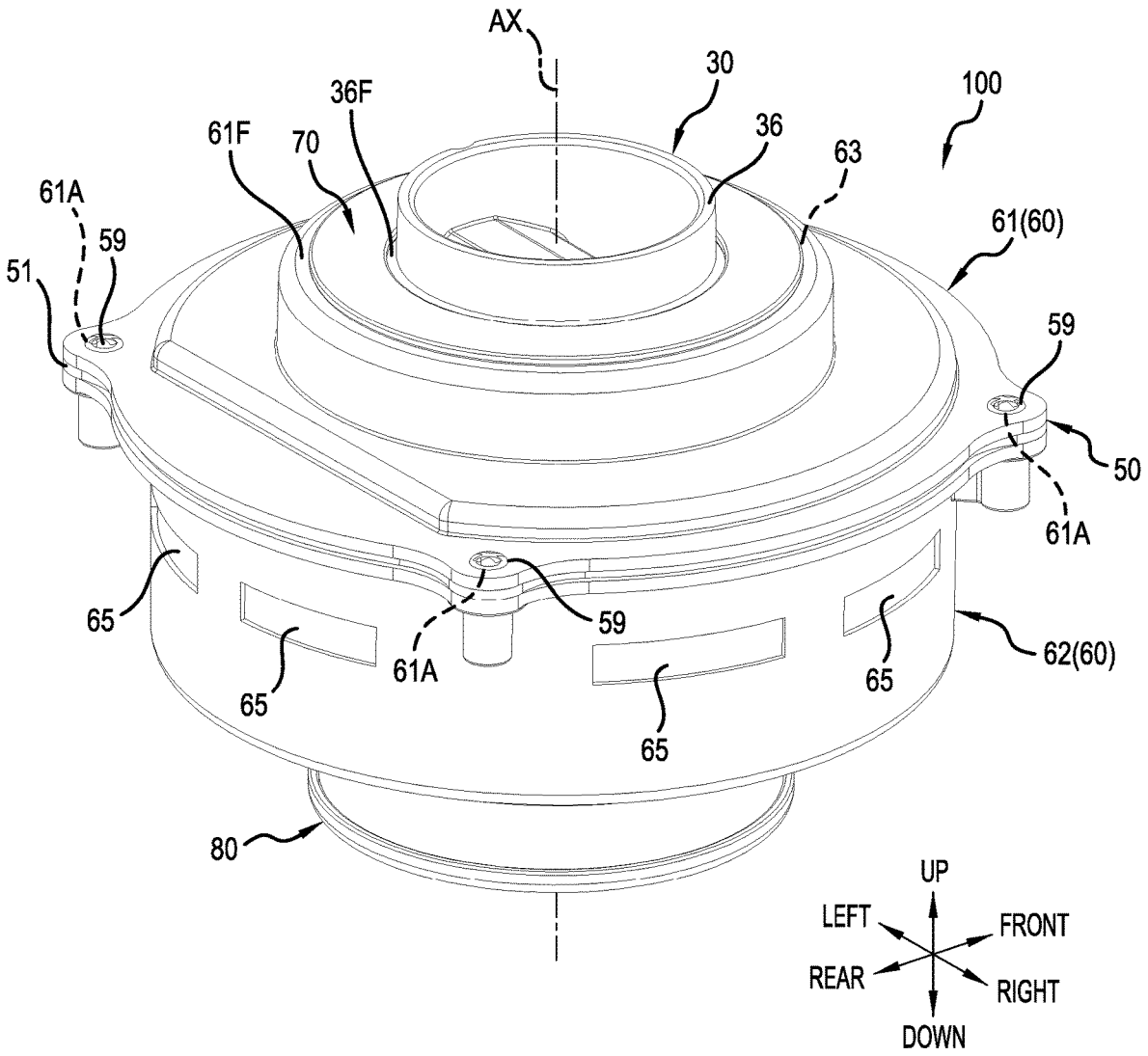
FIG. 7 shows an oblique view of the drive unit according to the first embodiment.
Figure 8:
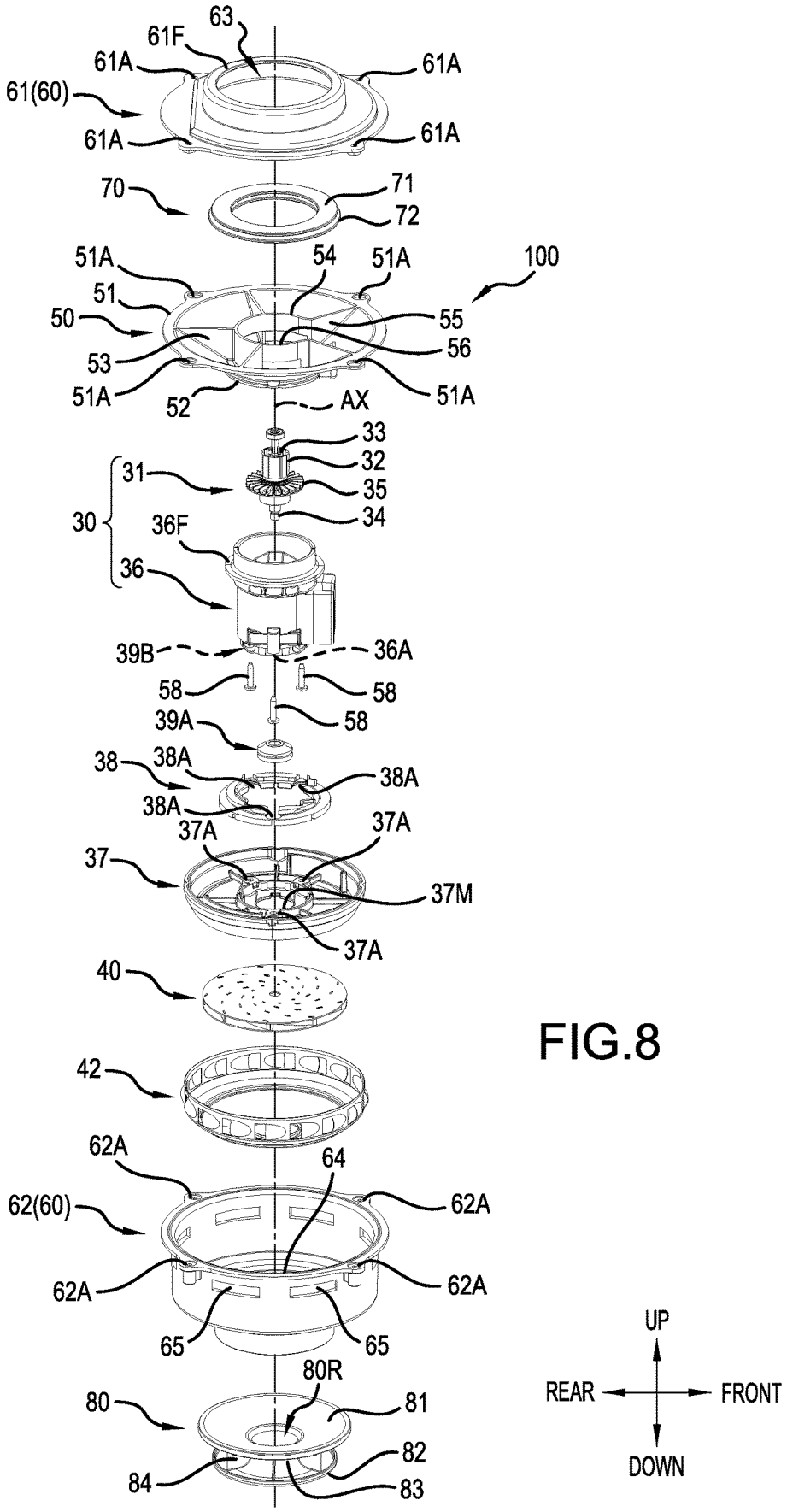
FIG. 8 shows an exploded, oblique view of the drive unit according to the first embodiment.

FIG. 6 shows a cross-sectional view of the drive unit 100 according to the first embodiment. FIG. 7 shows an oblique view of the drive unit 100. FIG. 8 shows an exploded, oblique view of the drive unit 100.

As shown in FIGS. 6-8, the drive unit 100 comprises the motor 30, a support member 50, a fan base (base member) 37, a spacer 38, the blower fan 40, a fan cover 42, a motor case 60, a first seal 70, and a second seal 80.

The motor 30 comprises a motor main body 31 and a motor housing 36, which is disposed around (surrounds) the motor main body 31.

The motor main body 31 comprises: a stator 32, which has a tube shape; a rotor 33, which is disposed inward of the stator 32; and a rotor shaft 34, which is connected to the rotor 33 so as to rotate therewith. Therefore, when the motor 30 is energized, the rotor 33 rotates about rotational axis AX of the motor 30. The motor 30 is disposed such that rotational axis AX extends in an up-down direction.

Therefore, both the rotor shaft 34 and the rotor 33 rotate about rotational axis AX. The rotor shaft 34 is connected to the blower fan 40. The rotor shaft 34 is rotatably supported by an upper bearing 34A and a lower bearing 34B. The upper bearing 34A rotatably supports an upper portion of the rotor shaft 34. The lower bearing 34B rotatably supports a lower portion of the rotor shaft 34. The upper bearing 34A is held by an upper bearing holding member 39A. The lower bearing 34B is held by a lower bearing holding member 39B. The upper bearing holding member 39A and the lower bearing holding member 39B are each held by the motor housing 36.

The motor housing 36 has a tube shape and houses (surrounds) at least a portion (preferably all) of the motor main body 31. The motor housing 36 is made of a rigid synthetic resin (polymer), such as, for example, polycarbonate resin.

The support member (support) 50 supports the motor 30 within the housing 2. As shown in FIGS. 6-8, the motor 30 is suspended from the support member 50. The support member 50 is flexible and is made of a rubber material or another type of elastomer. For example, the support member 50 may be made of a synthetic rubber such as, for example, nitrile rubber (NBR) or silicone rubber. The rubber material or elastomer of the support member 50 preferably has a Shore durometer (A scale or "Shore A"), which is also known as "Shore hardness", of 80 or less as measured according to JIS K 6253-3 (ISO 7619-1), preferably 75 or less. Herein, "JIS" stands for Japanese Industrial Standard and "ISO" stands for International Organization for Standardization. The rubber material or elastomer of the support member 50 preferably has a Shore A of 55 or more as measured according to JIS K 6253-3 (ISO 7619-1), preferably 60 or more.

Figure 9:
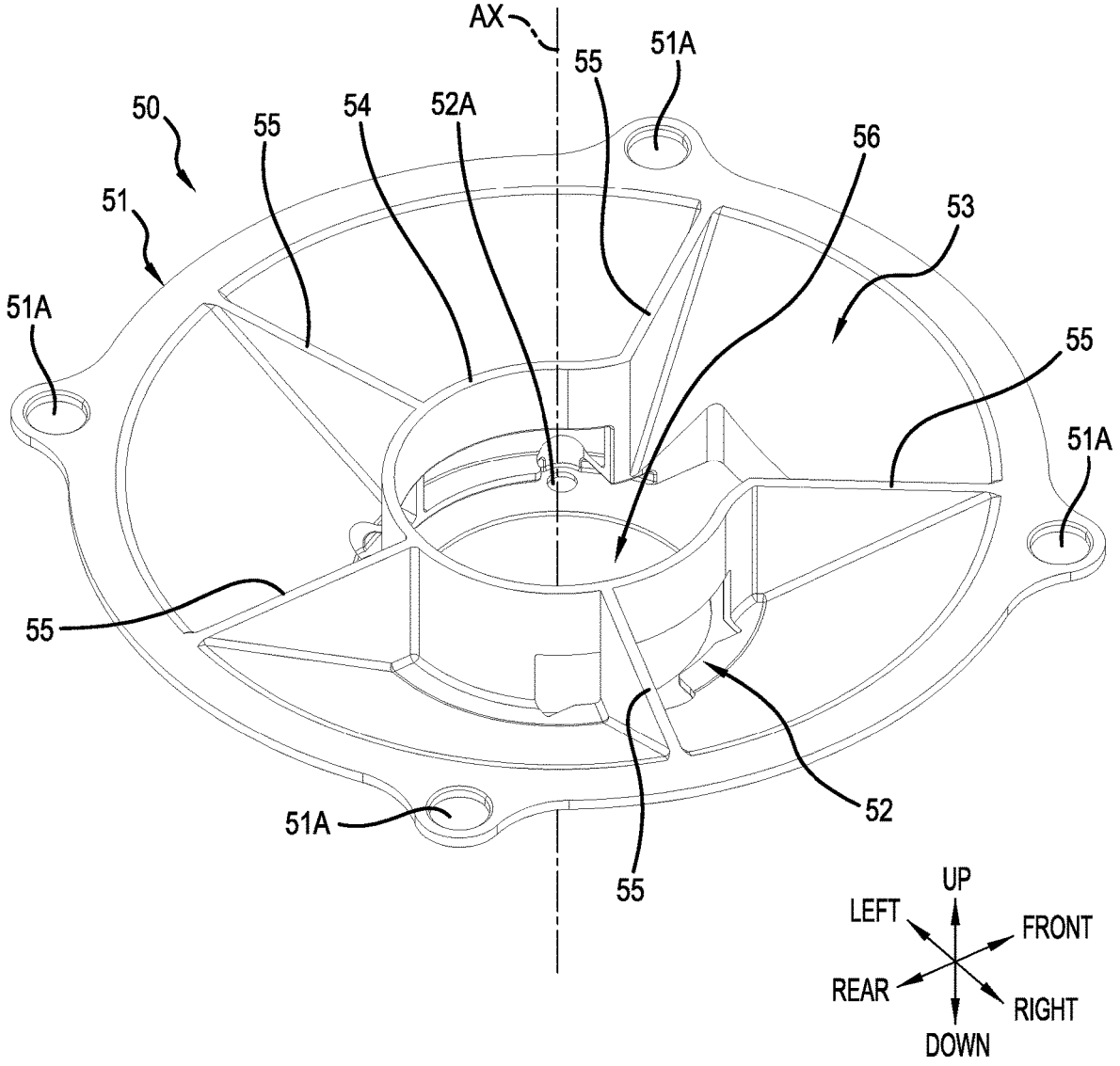
FIG. 9 shows an oblique view of a support member according to the first embodiment.

FIG. 9 shows an oblique view of the support member 50 according to the first embodiment. As shown in FIGS. 6-9, the support member 50 comprises a membrane portion (intermediate portion) 53 that connects an upper-end portion 51 and a lower-end portion 52. Herein, the term "membrane" is intended to mean a pliable (elastic) portion of the support member 50 that is preferably impermeable to at least liquids and solid foreign matter. Therefore, in particular, the membrane portion 53 acts as a water barrier and a dust barrier to prevent the ingress of foreign matter into the motor housing 36 while also attenuating vibration, as will be further explained below.

The upper-end portion 51 is connected to at least a portion of the motor case 60. The lower-end portion 52 is connected to the motor 30. In the first embodiment, the lower-end portion 52 is connected to the motor housing 36. The support member 50 suspends the motor housing 36.

The support member 50 is a ring-shaped element that is disposed around (surrounds) rotational axis AX. That is, the upper-end portion 51, the lower-end portion 52, and the membrane portion 53 are each disposed around (surround) rotational axis AX. In planes that are orthogonal to rotational axis AX, the upper-end portion 51, the lower-end portion 52, and the membrane portion 53 are each substantially ring shaped.

The upper-end portion 51 and the lower-end portion 52 each have a plate shape. The membrane portion 53 preferably has a truncated cone shape. The thickness of the upper-end portion 51 is substantially uniform. The thickness of the lower-end portion 52 is substantially uniform. The thickness of the membrane portion 53 is substantially uniform. The thickness of the upper-end portion 51 and the thickness of the lower-end portion 52 preferably may be equal or substantially equal. The membrane portion 53 may be thicker or thinner than the upper-end portion 51 and the lower-end portion 52 depending upon the particular application, the material selected for the support member 50 and the desired vibration attenuation properties.

At least the membrane portion 53 of the support member (support) 50 preferably has a thickness in the range of 1-3 millimeters, more preferably 1.5-2.5 millimeters. The tensile strength TS (or ultimate tensile strength UTS) of at least the membrane portion 53 of the support member 50 is preferably at least 3.0 MPa, more preferably at least 5.0 MPa, even more preferably at least 7.0 MPa. The upper limit of the tensile strength TS (or ultimate tensile strength UTS) of at least the membrane portion 53 of the support member (support) 50 is preferably 16 MPa or less, more preferably 12 MPa or less. In addition or in the alternative, at least the membrane portion 53 of the support member 50 preferably has an elongation at break of at least 150% as measured based on JIS K 6251 (ISO 37), more preferably at least 250%, even more preferably at least 300%. The upper limit of the elongation at break of at least the membrane portion 53 of the support member 50 is preferably 600% or less, more preferably 500% or less, even more preferably 400% or less.

In the present (first) embodiment, the entire support member 50 is formed from the same rubber or elastomer material, examples of which were described above. That is, the material of the support member 50 is uniform in the present embodiment. However, in alternate embodiments of the present teachings, a metal (reinforcing) ring may be embedded in the upper-end portion 51 and/or a metal (reinforcing) ring may be embedded in the lower-end portion 52. In addition or in the alternative, at least the membrane portion 53 may be formed from a different rubber or elastomer material than the upper-end portion 51 and/or the lower-end portion 52. For example, at least the membrane portion 53 may have a higher (greater) rubber hardness (Shore hardness) than the upper-end portion 51 and/or the lower-end portion 52 or at least the membrane portion 53 may have a lower (lesser) rubber hardness (Shore hardness) than the upper-end portion 51 and/or the lower-end portion 52. In addition or in the alternative, either one or both of the tensile strength and/or the elongation at break of at least the membrane portion 53 may be higher (greater) or lower (less) than the upper-end portion 51 and/or the lower-end portion 52.

At least a portion of the support member 50 is inclined upward as it goes outward in the radial direction of rotational axis AX. More specifically, in the first embodiment, the membrane portion 53 is inclined upward as it goes outward in the radial direction of rotational axis AX. That is, in the vertical direction, the diameter of at least a portion of, substantially all of, or all of the membrane portion 53 preferably expands (increases) in the direction from down to up. The expansion (increase) of the diameter of the membrane portion 53 is preferably monotonic (continuous), but may be step-wise in at least one section thereof. An upper surface and a lower surface of the upper-end portion 51 each define a plane that is orthogonal to rotational axis AX. An upper surface and a lower surface of the lower-end portion 52 also each define a plane that is orthogonal to rotational axis AX.

The lower-end portion 52 is disposed downward of the motor housing 36. The upper surface of the lower-end portion 52 makes contact with the lower surface of the motor housing 36.

The support member 50 also comprises a tube portion 54, which is disposed at least partially around (surrounding) the motor housing 36. An inner surface of the tube portion 54 makes contact with an outer surface of the motor housing 36.

In the first embodiment, the support member 50 supports the lower surface of the motor housing 36 via the lower-end portion 52 and supports the outer surface of the motor housing 36 via the tube portion 54.

In addition, the support member 50 also comprises a plurality of ribs 55, which connect the inner surface of the membrane portion 53 and the outer surface of the tube portion 54. The ribs 55 are arranged in a spaced apart relationship around rotational axis AX. In the first embodiment, the ribs 55 are arranged equispaced in (around) the circumferential direction of the support member 50, but the ribs 55 may be disposed with different spacings (distances) therebetween.

In addition, the support member 50 has an opening (through hole) 56, in which the lower portion of the rotor shaft 34 is disposed. The opening 56 is provided radially inward of the lower-end portion 52.

The fan base 37 is substantially disk shaped and is connected to a lower-end portion of the motor housing 36. The fan base 37 is made of a rigid synthetic resin (polymer) such as, for example, polycarbonate resin. The fan base 37 has an opening (through hole) 37M, in which the lower portion of the rotor shaft 34 is disposed. The opening 37M is formed in a center portion of the fan base 37.

The lower-end portion 52 of the support member 50 is interposed between the motor housing 36 and the fan base 37. In the first embodiment, the spacer 38 is disposed between the lower surface of the lower-end portion 52 and the fan base 37. The fan base 37 has screw holes 37A, in which screws 58 are respectively disposed (inserted). The spacer 38 has notches 38A, in which the screws 58 are respectively disposed (inserted). The lower-end portion 52 has screw holes 52A, in which the screws 58 are respectively disposed (inserted). Screw holes 36A, which threadably engage with the screws 58, are formed in the lower surface of the motor housing 36. That is, the screw holes 36A have thread grooves that respectively couple (engage) with screw threads of the screws 58.

When the lower-end portion 52 of the support member 50 and the spacer 38 are disposed between the motor housing 36 and the fan base 37, the fan base 37 and the motor housing 36 are coupled by the screws 58. Thereby, the motor housing 36, the lower-end portion 52 of the support member 50, the spacer 38, and the fan base 37 are fixed to one another.

The blower fan 40 is connected to the rotor shaft 34. Preferably, the blower fan 40 is fixed to the lower-end portion of the rotor shaft 34. A cooling fan 35 also is fixed to the lower portion of the rotor shaft 34. When the motor 30 runs (is driven), the blower fan 40 and the cooling fan 35 each rotate.

A suction force is generated in (at) the suction port 14 by the rotation of the blower fan 40. Air that has been suctioned via the suction port 14 into the interior space 15S of the tank 15 flows through the interior space 15S of the tank 15 and then flows into the blower fan 40. If the blower fan 40 is a centrifugal fan, air that has flowed into the blower fan 40 is exhausted to the periphery of the blower fan 40. Air that has been exhausted from the blower fan 40 is exhausted to outside of the housing 2 via the air-exhaust port 7.

When the cooling fan 35 rotates, air from outside of the housing 2 flows into the interior space of the housing 2 via the air-suction port 6. Air that has flowed into the interior space of the housing 2 via the air-suction port 6 flows through a cooling-supply passageway, which is provided in the interior space of the housing 2, and then is supplied to the interior of the motor housing 36 via an opening provided in the upper portion of the motor housing 36. Air that has been supplied to the interior of the motor housing 36 cools the motor main body 31 and then flows through a cooling-exhaust passageway, which is provided in the interior space of the housing 2. The cooling-exhaust passageway is fluidly connected to the air-exhaust port 7. Air that has flowed through the cooling-exhaust passageway is exhausted to outside of the housing 2 via the air-exhaust port 7.

The fan cover 42 is disposed around the blower fan 40 and is fixed to the fan base 37. Although the fan cover 42 is preferably made of metal, the fan cover 42 may instead be made of a rigid synthetic resin (polymer).

Figure 10:
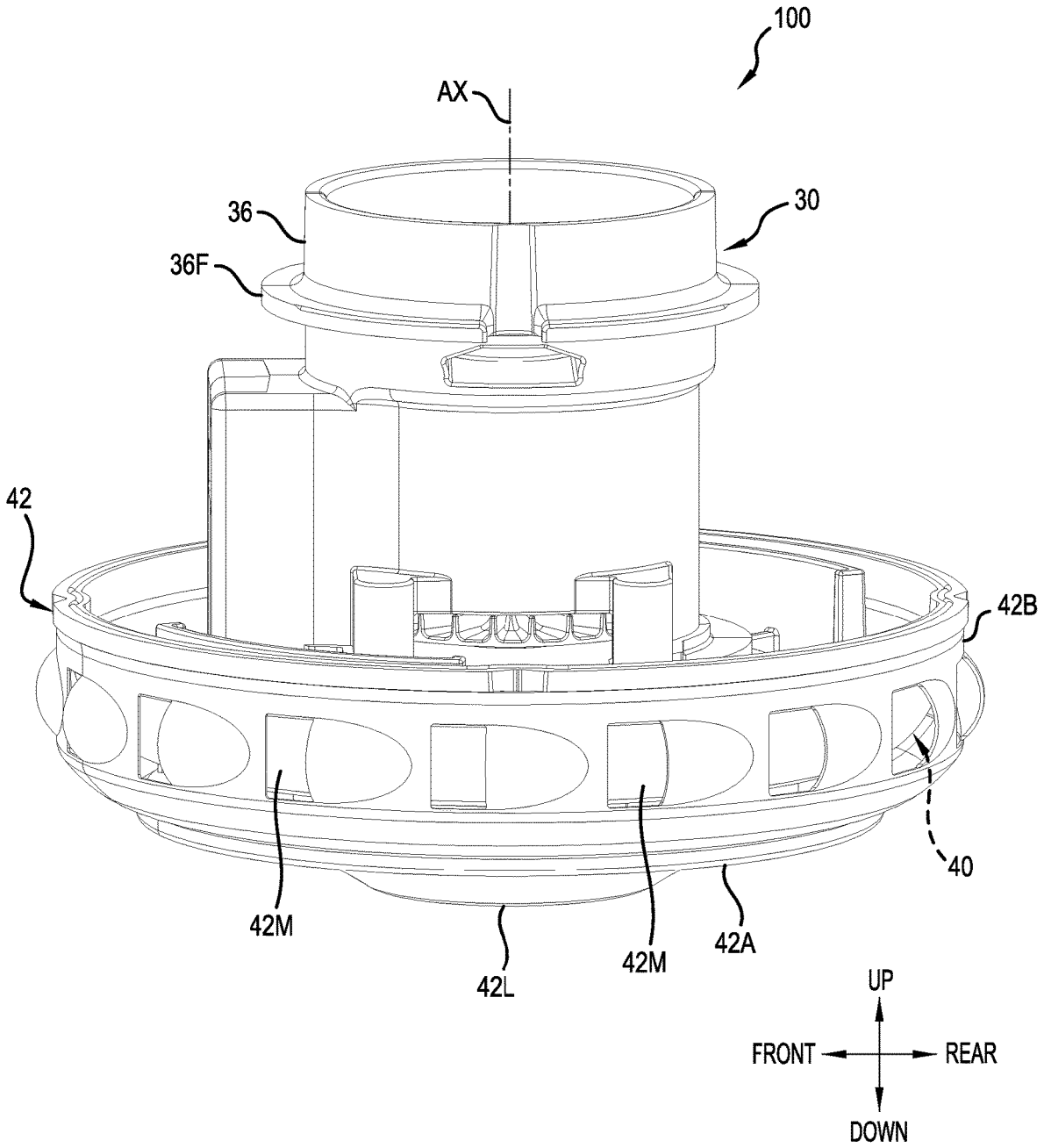
FIG. 10 shows an oblique view of a portion of the drive unit according to the first embodiment.

FIG. 10 shows an oblique view of a portion of the drive unit 100 according to the first embodiment. FIG. 10 corresponds to the state in which the motor case 60 and the support member 50 have been removed from the drive unit 100 shown in FIG. 7.

As shown in FIG. 10, the fan cover 42 comprises a bottom-plate portion 42A, which is disposed downward of the blower fan 40, and a side-plate portion 42B, which is disposed outward of the blower fan 40 in the radial direction of rotational axis AX. The fan cover 42 has an inflow port (intake port) 42L, through which air that flows into the blower fan 40 passes, and a plurality of outflow ports 42M, through which air that has been exhausted from the blower fan 40 passes. The inflow port 42L is provided in a center portion of the bottom-plate portion 42A. The outflow ports 42M are provided in the side-plate portion 42B uniformly spaced apart in a circumferential direction of rotational axis AX.

The motor case 60 is supported by at least a portion of the housing 2. As shown in FIGS. 6-8, the motor case 60 supports the upper-end portion 51 of the support member 50. The motor case 60 houses the motor 30, the fan base 37, the spacer 38, the blower fan 40, the fan cover 42, and the support member 50. Although the motor case 60 is preferably made of a rigid synthetic resin (polymer), the motor case 60 may instead be made of metal.

The motor case 60 comprises an upper case 61 and a lower case 62, which is connected to the upper case 61. The upper-end portion 51 of the support member 50 is interposed between the upper case 61 and the lower case 62. The upper case 61 has screw holes 61A, in which screws 59 are respectively disposed (inserted). The upper-end portion 51 has screw holes 51A, in which the screws 59 are respectively disposed (inserted). The lower case 62 has screw holes 62A, which respectively engage (are coupled to) the screws 59. That is, the screw holes 62A have thread grooves, which threadably engage with the screw threads of the screws 59.

When the upper-end portion 51 of the support member 50 is disposed between the upper case 61 and the lower case 62, the upper case 61 and the lower case 62 are coupled by the screws 59. Thereby, the upper case 61, the upper-end portion 51 of the support member 50, and the lower case 62 are fixed to one another.

The motor case 60 has openings 65. The openings 65 fluidly connect the interior space of the motor case 60 with the space surrounding the motor case 60. In the first embodiment, the openings 65 are formed in a side surface of the lower case 62 such that air can flow through the openings 65.

Figure 11:
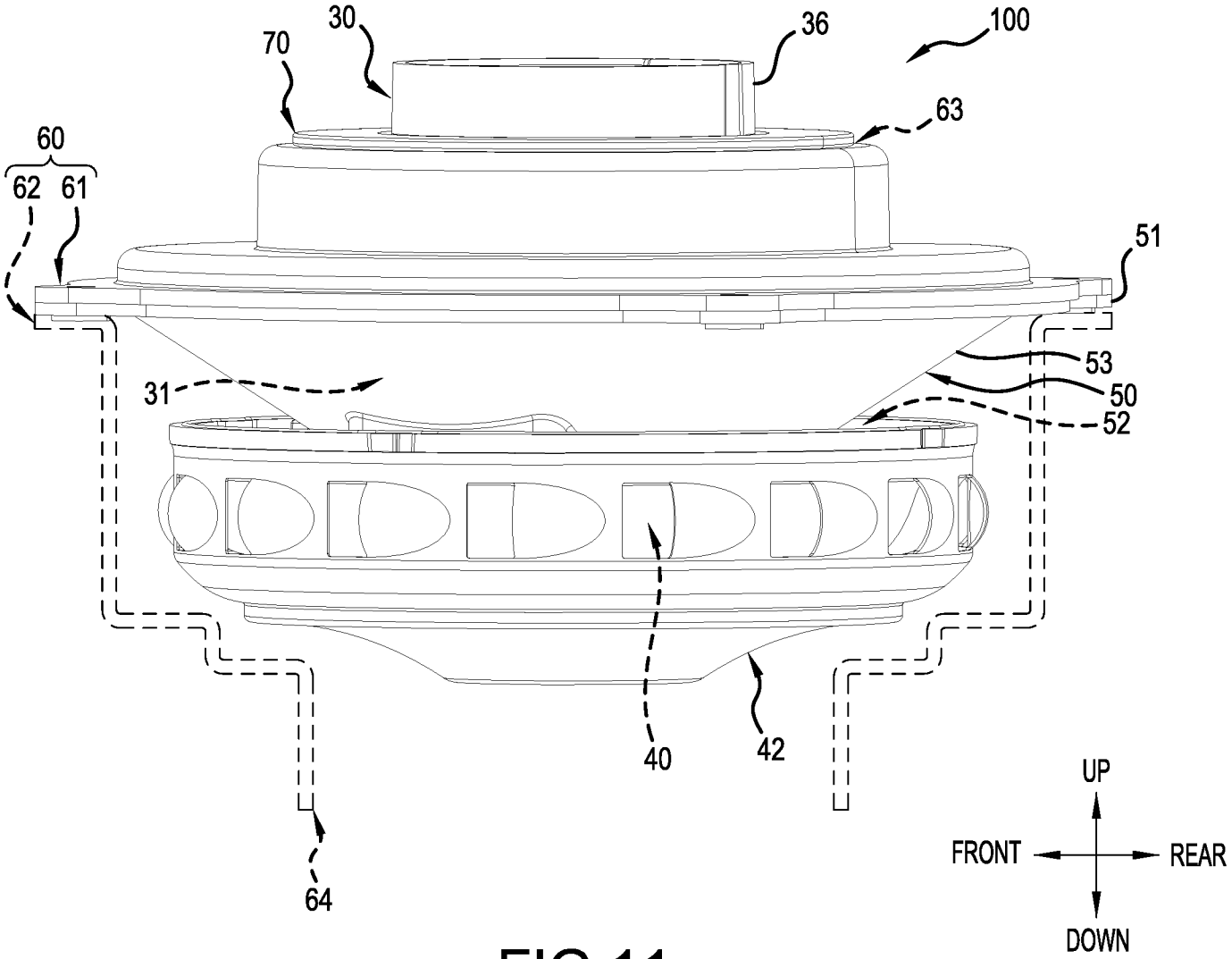
FIG. 11 shows a side view of the drive unit according to the first embodiment.

FIG. 11 shows a side view of the drive unit 100 according to the embodiment. In FIG. 11, the lower case 62 is shown by virtual (dashed) lines and the second seal 80 is not shown.

As described above, the motor housing 36, the lower-end portion 52 of the support member 50, the spacer 38, and the fan base 37 are fixed to one another by the screws 58. The blower fan 40 is fixed to the rotor shaft 34 of the motor 30. The fan cover 42 is fixed to the fan base 37. In the first embodiment, the motor 30, the fan base 37, the blower fan 40, and the fan cover 42 are each suspended from the support member 50.

The upper-end portion 51 of the support member 50 is connected to the motor case 60. As shown in FIGS. 6 and 11, the membrane portion (intermediate portion) 53 of the support member 50, which connects the upper-end portion 51 and the lower-end portion 52, is spaced apart from the motor 30 and from the motor case 60. In addition, the blower fan 40 and the fan cover 42 are spaced apart from the motor case 60.

The motor 30, the fan base 37, the blower fan 40, and the fan cover 42 are each suspended from the motor case 60 via the support member 50.

As shown in FIGS. 6 and 8, the upper case 61 has an upper opening (upper-opening portion or upper through hole) 63, which is disposed upward of the support member 50. An upper-end portion of the motor housing 36 of the motor 30 is disposed in the upper opening 63. The lower case 62 has a lower opening (lower-opening portion or lower through hole) 64, which is disposed downward of the blower fan 40.

The first seal 70 seals the boundary between the motor housing 36 and the upper case 61, which are disposed in the upper opening 63. The first seal 70 is flexible and is preferably made of a rubber material or other type of elastomer. The first seal 70 is preferably made of a synthetic rubber such as nitrile rubber (NBR) or silicone rubber.

Figure 12:
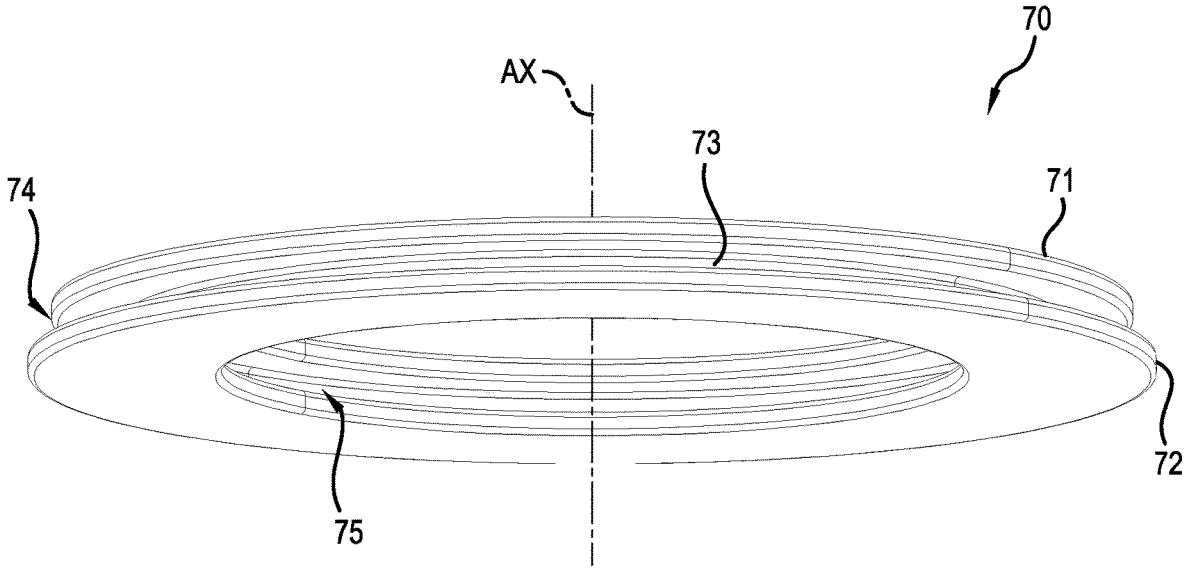
FIG. 12 shows an oblique view of a first seal according to the first embodiment.

FIG. 12 shows an oblique view of the first seal 70 according to the first embodiment. As shown in FIGS. 6, 8, and 12, the first seal 70 comprises an upper-ring portion 71, a lower-ring portion 72, and a tube portion 73, which connects the upper-ring portion 71 and the lower-ring portion 72. An outer-side recess (groove) 74 is formed by an outer-end portion of the upper-ring portion 71, an outer-end portion of the lower-ring portion 72, and an outer surface of the tube portion 73. An inner-side recess (groove) 75 is formed by an inner-end portion of the upper-ring portion 71, an inner-end portion of the lower-ring portion 72, and an inner surface of the tube portion 73.

As shown in FIG. 6, an upper-end portion 61F of the upper case 61 is fitted into the outer-side recess 74. In a plane orthogonal to rotational axis AX, the upper-end portion 61F has a ring shape. A flange 36F, which is provided on the motor housing 36, is fitted into the inner-side recess 75.

The second seal 80 makes contact with the lower case 62 and has a passageway 80R that fluidly connects the lower opening 64 and the blower fan 40. In the first embodiment, the second seal 80 seals the boundary between the lower case 62 and the fan cover 42. The second seal 80 is also preferably made of a synthetic rubber such as nitrile rubber (NBR) or silicone rubber, although it may be made of another elastomeric material. The passageway 80R fluidly connects the lower opening 64 and the inflow port 42L of the fan cover 42.

Figure 13:
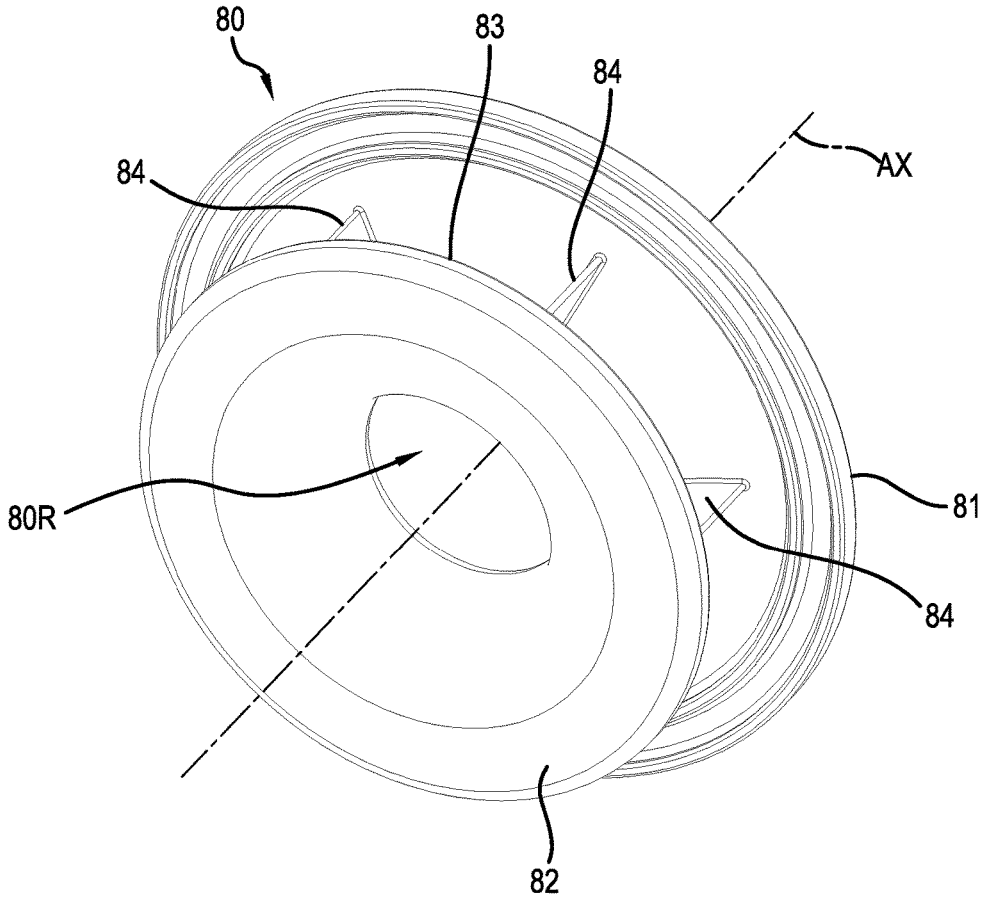
FIG. 13 shows an oblique view of a second seal according to the first embodiment.

FIG. 13 shows an oblique view of the second seal 80 according to the first embodiment. As shown in FIGS. 6, 8, and 13, the second seal 80 comprises an upper-ring portion 81, a lower-ring portion 82, and a tube portion 83, which connects the upper-ring portion 81 and the lower-ring portion 82. In addition, the second seal 80 comprises ribs 84, which are connected to the lower surface of the upper-ring portion 81, the upper surface of the lower-ring portion 82, and the outer surface of the tube portion 83.

As shown in FIG. 6, the upper surface of the upper-ring portion 81 makes contact with the lower surface of the bottom-plate portion 42A of the fan cover 42. The outer-end portion of the lower-ring portion 82 makes contact with a lower-end portion 62F of the lower case 62. The passageway 80R is formed radially inward of the tube portion 83. The passageway 80R fluidly connects the lower opening 64 of the lower case 62 and the inflow port 42L of the fan cover 42.

Operation

The operation of the dust extractor 1 will now be explained. When the motor 30 runs (is driven), the blower fan 40 and the cooling fan 35 each rotate.

A suction force is generated in (at) the suction port 14 by the rotation of the blower fan 40. Air that has been suctioned via the suction port 14 into the interior space 15S of the tank 15 flows through the interior space 15S of the tank 15 and then flows into the lower opening 64 of the motor case 60. Air that has flowed into the lower opening 64 flows through the passageway 80R and then flows into the blower fan 40 via the inflow port 42L of the fan cover 42. The outer-end portion of the lower-ring portion 82 of the second seal 80 is in tight contact (preferably, air-tight contact or at least substantially air-tight contact) with the lower-end portion 62F of the lower case 62. The upper surface of the upper-ring portion 81 of the second seal 80 is in tight contact (preferably, air-tight contact or at least substantially air-tight contact) with the lower surface of the bottom-plate portion 42A of the fan cover 42. The boundary between the lower-end portion 62F of the lower case 62 and the fan cover 42 is thereby sealed by the second seal 80. As a result, leakage (suction losses) from the passageway 80R of air that has flowed into the passageway 80R is curtailed. Air that has flowed through the passageway 80R flows into the blower fan 40 via the inflow port 42L.

Air that has flowed into the blower fan 40 is exhausted to the periphery of the blower fan 40. Air that has been exhausted from the blower fan 40 is exhausted to the outside of the housing 2 via the openings 65 of the motor case 60 and the air-exhaust port 7.

Rotation of the motor 30 and/or rotation of the blower fan 40 tends to generate vibrations. If the housing 2 of the dust extractor 1 were to vibrate due to this vibration, then unpleasant noise will be generated. In the first embodiment, because the motor 30 is suspended from the pliable support member 50, vibration from the motor 30 and/or the blower fan 40 is attenuated and thereby vibration of the housing 2 is reduced.

Figure 14:
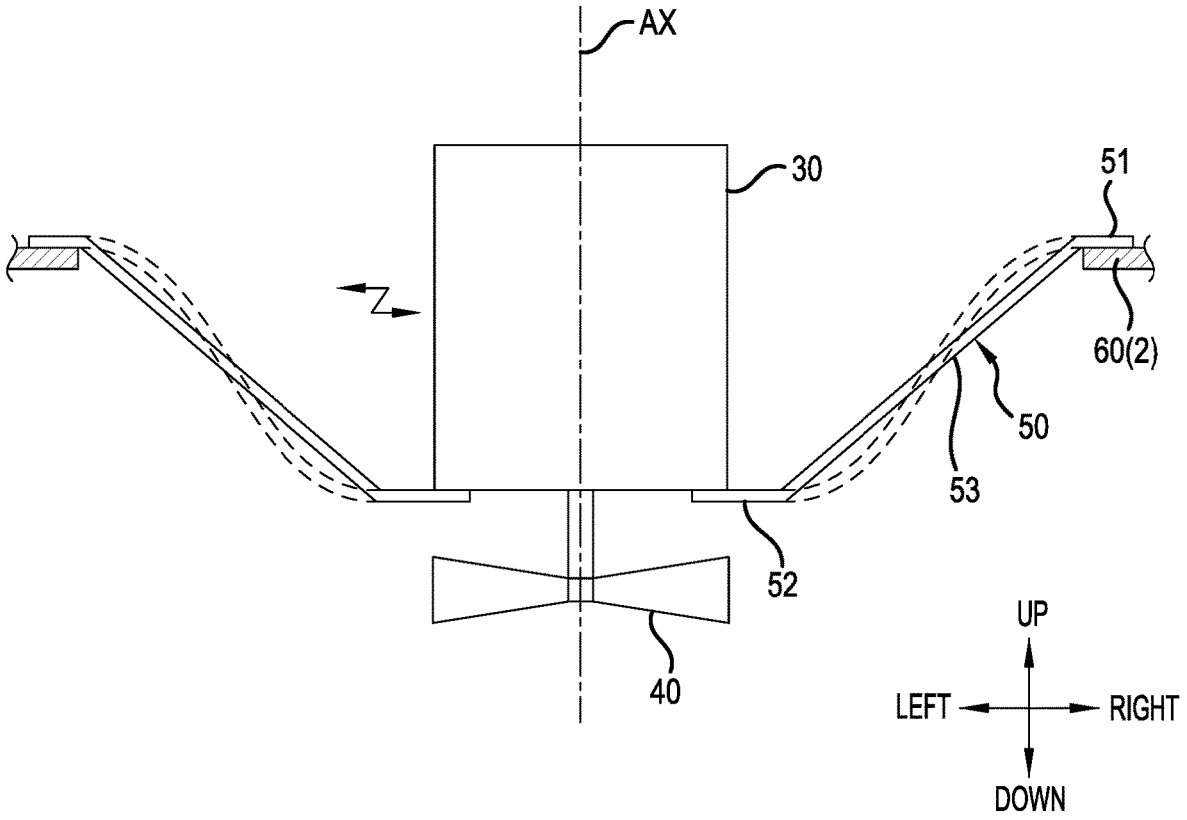
FIG. 14 shows a schematic drawing for explaining the function of the support member according to the first embodiment.

FIG. 14 shows a schematic drawing for explaining the function of the support member 50 according to the first embodiment. As shown in FIG. 14, the motor 30 is held in a suspended state by a lower portion of the flexible (pliable) support member 50. In addition, the motor case 60 holds the motor 30 in the suspended state via an upper portion of the flexible (pliable) support member 50. Consequently, when the motor 30 and the blower fan 40 vibrate, the support member 50 flexes and thereby absorbs (attenuates) the vibration. Thereby, vibration of the motor case 60, vibration of the housing 2, and the like are curtailed as compared to embodiments that do not utilize a flexible (pliable) support member 50.

Effects

According to the first embodiment explained above, the motor 30 is suspended via the flexible (pliable) support member 50. When the motor 30 and the blower fan 40 vibrate, the support member 50 can flex sufficiently to absorb some or all of the vibration generated by the motor 30 and the blower fan 40. Consequently, propagation to the housing 2 of vibration generated by the motor 30 and the blower fan 40 is curtailed, thereby reducing the generation of unpleasant noise.

In the first embodiment, the support member 50 is preferably made of rubber or other elastomer having a Shore durometer A of 80 or less. Therefore, because the support member 50 is sufficiently flexible (pliable), the generation of noise can be effectively curtailed.

Rotational axis AX of the motor 30 extends in the up-down direction. Because the motor 30 is suspended via the support member 50 with rotational axis AX extending vertically, vibration generated by the motor 30 is effectively absorbed by the support member 50.

At least a portion of the support member 50 is inclined upward as it goes outward in the radial direction of rotational axis AX. Thereby, the support member 50 can flex by an appropriate amount of flexure. Because excessive flexing of the support member 50 is curtailed, for example, excessive movement of the motor 30 within a plane orthogonal to rotational axis AX is curtailed.

The support member 50 comprises the water-impermeable membrane portion 53. Therefore, even if liquid is suctioned in via the suction port 14, contact between the motor 30 and the liquid is impeded (blocked) by the water-impermeable membrane portion 53.

The support member 50 has the opening (through hole) 56, in which the lower portion of the rotor shaft 34 is disposed. Thereby, the rotor shaft 34 and the blower fan 40 can be connected with one another.

The motor 30 comprises the motor main body 31 and the motor housing 36. The motor main body 31 is protected by the motor housing 36. Because the support member suspends the motor housing 36, the support member 50 can also suspend the motor 30; i.e. the support member 50 holds the motor 30 in a suspended state such that the motor 30 does not directly contact the housing 2 via a rigid structure.

The lower-end portion 52 of the support member 50 is interposed between the motor housing 36 and the fan base 37. Thereby, the connection between the motor 30 and the lower-end portion 52 of the support member 50 is stable. Furthermore, because the lower-end portion 52 is made of a flexible (pliable) material, it will also absorb (attenuate) vibration.

In the first embodiment, the support member 50 suspends the drive unit 100, which comprises the motor 30, the fan base 37, the blower fan 40, and the fan cover 42. Consequently, the generation of noise caused by vibration of the motor 30 and the blower fan 40 is effectively curtailed.

The upper-end portion 51 of the support member 50 is supported by the motor case 60. Thereby, the motor case 60 can suspend the motor 30 via the support member 50.

The membrane portion (intermediate portion) 53 of the support member 50, which connects the upper-end portion 51 and the lower-end portion 52, is spaced apart from the motor 30 and from the motor case 60. Thereby, the vibration-propagation path can be minimized, thereby effectively reducing the generation of noise.

The motor case 60 houses the motor 30, the support member 50, and the blower fan 40. Because the motor 30 and the blower fan 40 are housed in the motor case 60, the propagation of noise generated by the motor 30 and the blower fan 40 to the outside of the motor case 60 is curtailed (attenuated) by the sound-insulating effect of the motor case 60.

The upper-end portion 51 of the support member 50 is interposed between the upper case 61 of the motor case 60 and the lower case 62. Thereby, the connection between the motor case 60 and the upper-end portion 51 of the support member 50 is stable. Furthermore, because the upper-end portion 51 is made of a flexible (pliable) material, it will also absorb (attenuate) vibrations.

The first seal 70 also functions to effectively curtail (attenuate) the propagation of vibration, which is generated in the motor 30 and the blower fan 40, to the motor case 60, thereby further reducing the generation of unpleasant noise. In addition, ingress of foreign matter into the interior of the motor case 60 is impeded by the first seal 70. Moreover, when the cooling fan 35 rotates, air for cooling the motor main body 31 is supplied into the interior of the motor housing 36 via the opening provided in the upper portion of the motor housing 36. Leakage of air for cooling the motor main body 31 is curtailed (blocked) by the first seal 70, thereby reducing suction losses.

The second seal 80 also functions to effectively curtail (attenuate) the propagation of vibration, which generated in the motor 30 and the blower fan 40, to the motor case 60, thereby further reducing the generation of unpleasant noise. In addition, ingress of foreign matter into the interior of the motor case 60 is impeded (block) by the second seal 80. Moreover, air that has been suctioned via the suction port 14 passes through the passageway 80R and can smoothly flow into the blower fan 40. Because the second seal 80 tightly contacts the fan cover 42 (preferably in an air-tight manner or in a substantially air-tight manner), leakage (through the boundary between the second seal 80 and the fan cover 42) of air that flows through the passageway 80R is curtailed (blocked) by the second seal 80.

OTHER EMBODIMENTS

Figure 15:
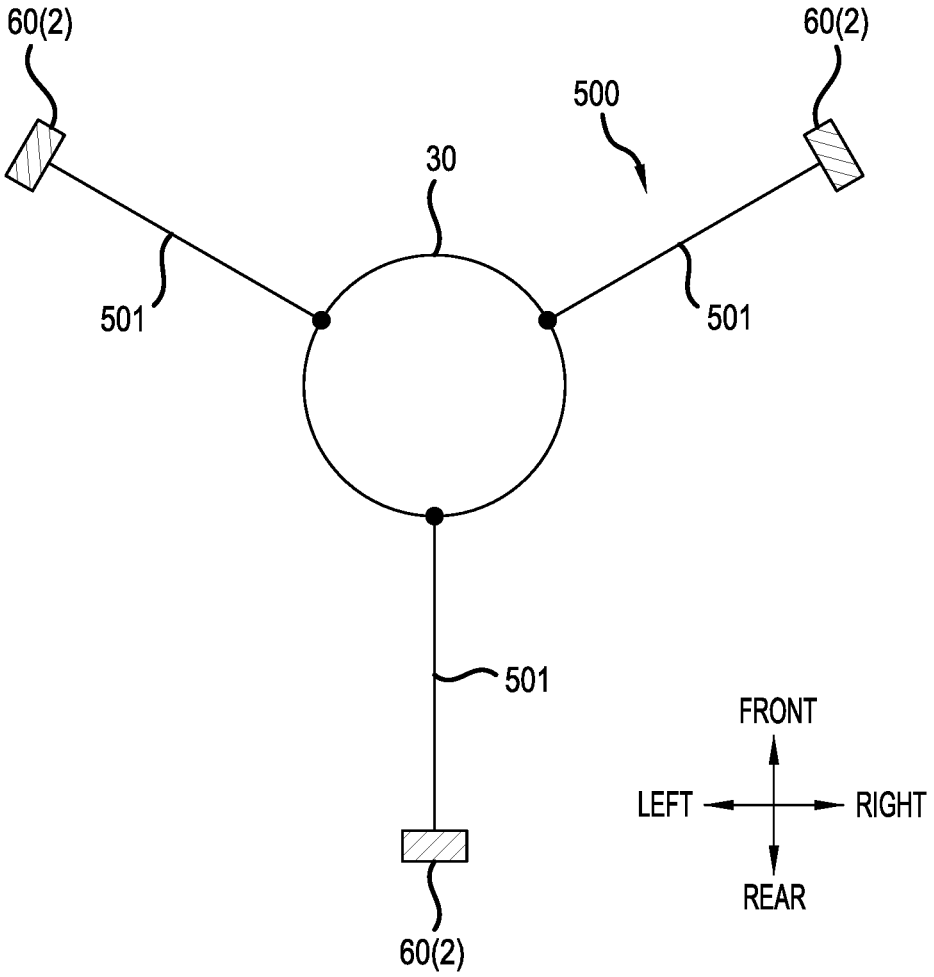
FIG. 15 shows a schematic drawing of the support member according to a second embodiment of the present teachings.

FIG. 15 shows a schematic drawing of a support member 500 according to a second embodiment of the present teachings. As shown in FIG. 15, the support member 500 may comprise a plurality of wires 501 attached to the motor case 60 (60(2)). In addition, the support member 500 does not have to be made of rubber, as long as it is flexible. For example, the wires 501 may be made of metal or may be made of fiber.

It is noted that, in the embodiments described above, the motor case 60 may be omitted. In such modified embodiments, the support member 50 may be supported by at least a portion of the housing 2.

In the embodiments described above, the dust extractor 1 is movable across a surface to be cleaned on the castors 3. However, the castors 3 may be omitted. In such modified embodiments, the dust extractor 1 may be a so-called box-type (canister) dust extractor (vacuum cleaner), in which the dust extractor 1 is used in the state in which the dust extractor 1 is held or carried by the user (e.g., a compact vacuum cleaner or handheld vacuum cleaner) or in the state in which the dust extractor 1 is supported by the user's shoulders via a shoulder belt (e.g., a backpack vacuum cleaner).

In the embodiments described above, one or two batteries (battery packs) 10 was (were) mounted on the battery-mounting part(s) 11 to serve as the power supply of the dust extractor 1. However, in addition or in the alternative to the batteries 10, a commercial power supply (AC power supply) may be used as the power supply of the dust extractor. In this case, the dust extractor may have a power cord with a plug for conducting alternating current (100-240 VAC) to the electrical components within the dust extractor.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved dust extractors, vacuum cleaners, dust collectors, etc.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Additional embodiments of the present teachings include, but are not limited to:

1. A dust extractor (1) comprising:

a motor (30);

a blower fan (40), which is disposed downward of the motor and is connected to the motor; and a flexible support member (50; 500) having a lower-end portion (52) connected to the motor, the flexible support member suspending the motor.

2. The dust extractor (1) according to the above Embodiment 1, wherein the support member (50) comprises rubber having a Shore durometer A of 80 or less, preferably 75 or less.

3. The dust extractor (1) according to the above Embodiment 1 or 2, wherein the rubber has a Shore durometer A of 55 or more, preferably 60 or more.

4. The dust extractor (1) according to any one of the above Embodiments 1-3, wherein the motor (30) is disposed such that a rotational axis (AX) of the motor extends in an up-down direction.

5. The dust extractor (1) according to the above Embodiment 4, wherein the support member (50; 500) includes a portion (53; 501) that is inclined upward as it goes outward in the radial direction of the rotational axis (AX).

6. The dust extractor (1) according to the above Embodiment 4 or 5, wherein the support member (50) comprises a membrane portion (53), which is disposed around the rotational axis and has a ring shape in transverse cross-section.

7. The dust extractor (1) according to the above Embodiment 6, wherein the membrane portion (53) has a thickness in a range of 1-3 millimeters, preferably 1.5-2.5 millimeters.

8. The dust extractor (1) according to the above Embodiment 6 or 7, wherein the membrane portion (53) has a tensile strength of at least 3.0 MPa, preferably at least 5.0 MPa, further preferably at least 7.0 MPa.

9. The dust extractor (1) according to any one of the above Embodiments 6-8, wherein the membrane portion (53) has an elongation at break of at least 150%, preferably at least 250%, further preferably at least 300%.

10. The dust extractor (1) according to any one of the above Embodiments 6-9, wherein:

the motor (30) comprises a rotor shaft (34) connected to the blower fan (40); and the membrane portion (53) has an opening (56), in which the rotor shaft is disposed.

11. The dust extractor (1) according to any one of the above Embodiments 1-10, wherein:

the motor (30) comprises a motor main body (31) and a motor housing (36), which is disposed around the motor main body; and the support member (50; 500) suspends the motor housing.

12. The dust extractor (1) according to the above Embodiment 11, comprising:

a base member (37) connected to the motor housing (36);

wherein the lower-end portion (52) of the support member (50) is interposed between the motor housing and the base member.

13. The dust extractor (1) according to the above Embodiment 12, comprising:

a fan cover (42), which is disposed around the blower fan (40) and is fixed to the base member (37);

wherein the support member (50) suspends the motor (30), the base member (37), the blower fan (40), and the fan cover (42).

14. The dust extractor (1) according to any one of the above Embodiments 1-13, comprising a motor case (60), which supports an upper-end portion (51) of the support member (50).

15. The dust extractor (1) according to the above Embodiment 14, wherein an intermediate portion (53) of the support member (50) between the upper-end portion (51) and the lower-end portion (52) is spaced apart from the motor (30) and from the motor case (60).

16. The dust extractor (1) according to the above Embodiment 14 or 15, wherein the motor case (60) houses the motor (30), the support member (50), and the blower fan (40).

17. The dust extractor (1) according to any one of the above Embodiments 14-16, wherein:

the motor case (60) comprises an upper case (61) and a lower case (62), which is connected to the upper case; and the upper-end portion (51) of the support member (50) is interposed between the upper case and the lower case.

18. The dust extractor (1) according to the above Embodiment 17, wherein:

the upper case (61) has an upper opening (63), which is disposed upward of the support member (50);

an upper-end portion of the motor (30) is disposed in the upper opening; and a first seal (70) seals a boundary between the motor and the upper case.

19. The dust extractor (1) according to the above Embodiment 17 or 18, wherein:

the lower case (62) has a lower opening (64), which is disposed downward of the blower fan (40); and a second seal (80) contacts the lower case and has a passageway (80R), which is fluidly connected with the lower opening.

EXPLANATION OF THE REFERENCE NUMBERS

1 Dust extractor
2 Housing
2A First housing portion
2B Second housing portion
2C Third housing portion
2D Fourth housing portion
2E Fifth housing portion
2F Sixth housing portion
3 Castor
4 Handle
5 Battery cover
6 Air-suction port
7 Air-exhaust port
8 Latch
9 Hook
10 Battery (battery pack, battery cartridge)
11 Battery-mounting part
12 Operation panel
12A Manually-operable part
12Aa Stand-by switch
12Ab Suction-force adjustment switch dial
12B Display part
13 Motor ON/OFF button
13A Motor ON/OFF display lamp
14 Suction port
15 Tank
15M Opening
15S Interior space
16 Joint member
17 Support plate
17F Passageway
21 Tank housing
22 Main-body housing
30 Motor
31 Motor main body
32 Stator
33 Rotor
34 Rotor shaft
34A Bearing
34B Bearing
35 Cooling fan
36 Motor housing
36A Screw hole
36F Flange
37 Fan base (base member)
37A Screw hole
37M Opening
38 Spacer
38A Notch
39A Bearing holding member
39B Bearing holding member
40 Blower fan
42 Fan cover
42A Bottom-plate portion
42B Side-plate portion
42L Inflow port
42M Outflow port
50 Support member
51 Upper-end portion
51A Screw hole
52 Lower-end portion
52A Screw hole
53 Membrane portion (intermediate portion)
54 Tube portion
55 Rib
56 Opening
58 Screw
59 Screw
60 Motor case
61 Upper case
61F Upper-end portion
61A Screw hole
62 Lower case
62A Screw hole
62F Lower-end portion
63 Upper opening
64 Lower opening
65 Opening
70 First seal
71 Upper-ring portion
72 Lower-ring portion
73 Tube portion
74 Outer-side recess
75 Inner-side recess
80 Second seal
80R Passageway
81 Upper-ring portion
82 Lower-ring portion
83 Tube portion
84 Rib
100 Drive unit
500 Support member
501 Wire

I claim:

1. A motor assembly comprising:

a motor;

a blower fan disposed downward of the motor and connected to the motor;

a flexible support member having a lower-end portion connected to the motor, the flexible support member suspending the motor; and a motor case supporting an upper-end portion of the flexible support member;

wherein:

the motor case comprises a lower case connected to an upper case; and the upper-end portion of the flexible support member is interposed between the upper case and the lower case at a connection location of the upper case and lower case.

2. The motor assembly according to claim 1, wherein:

the flexible support member is made of rubber; and the flexible support member has a Shore durometer A of 80 or less.

3. The motor assembly according to claim 2, wherein the flexible support member has a Shore durometer A of 55 or more.

4. The motor assembly according to claim 1, wherein the motor is disposed such that a rotational axis of the motor extends in an up-down direction.

5. The motor assembly according to claim 4, wherein the flexible support member includes a portion that is inclined upward as it goes outward in the radial direction of the rotational axis.

6. The motor assembly according to claim 4, wherein the flexible support member comprises a membrane portion disposed around the rotational axis and having a ring shape in transverse cross-section.

7. The motor assembly according to claim 6, wherein the membrane portion has a thickness in a range of 1-3 millimeters.

8. The motor assembly according to claim 6, wherein the membrane portion has a tensile strength of at least 3.0 MPa.

9. The motor assembly according to claim 6, wherein the membrane portion has an elongation at break of at least 150%.

10. The motor assembly according to claim 6, wherein:

the motor comprises a rotor shaft connected to the blower fan; and the membrane portion has an opening, in which the rotor shaft is disposed.

11. The motor assembly according to claim 1, wherein:

the motor comprises a motor main body and a motor housing, which is disposed around the motor main body; and the flexible support member suspends the motor housing.

12. The motor assembly according to claim 11, further comprising:

a base member connected to the motor housing;

wherein the lower-end portion of the flexible support member is interposed between the motor housing and the base member.

13. The motor assembly according to claim 12, further comprising:

a fan cover disposed around the blower fan and fixed to the base member;

wherein the flexible support member suspends the motor, the base member, the blower fan, and the fan cover.

14. The motor assembly according to claim 1, wherein an intermediate portion of the flexible support member between the upper-end portion and the lower-end portion of the flexible support member is spaced apart from the motor and from the motor case.

15. The motor assembly according to claim 14, wherein the motor case houses the motor, the support member, and the blower fan.

16. The motor assembly according to claim 1, wherein:

the upper case has an upper opening, which is disposed upward of the support member;

an upper-end portion of the motor is disposed in the upper opening; and a first seal seals a boundary between the motor and the upper case.

17. The motor assembly according to claim 16, wherein:

the lower case has a lower opening, which is disposed downward of the blower fan; and a second seal contacts the lower case and has a passageway, which is fluidly connected with the lower opening.

18. The motor assembly according to claim 17, further comprising:

a motor housing that houses the motor case;

a base member connected to the motor housing; and a fan cover disposed around the blower fan and fixed to the base member;

wherein:

the lower-end portion of the flexible support member is interposed between the motor housing and the base member;

the flexible support member suspends the motor, the motor case, the motor housing, the base member, the blower fan, and the fan cover;

the intermediate portion comprises a water-impermeable, truncated cone-shaped membrane portion made of an elastomer having a Shore durometer A in a range of 55-80, a tensile strength of at least 3.0 MPa and an elongation at break of at least 150%;

the membrane portion has a thickness in a range of 1-3 millimeters;

the motor is disposed such that a rotational axis of a rotor shaft of the motor extends in an up-down direction; and the membrane portion has through hole, in which the rotor shaft is disposed.

19. A dust extractor comprising:

a housing having a suction port;

a tank disposed in the housing; and the motor assembly according to claim 1 disposed in the housing in a fluid communication path between the suction port and the tank.

20. The dust extractor according to claim 19, wherein:

the flexible support member is made of rubber and has a Shore durometer A of 80 or less; and the flexible support member comprises a membrane portion disposed around a rotational axis of a rotor shaft of the motor and having a ring shape in transverse cross-section.

* * * * *